United States Patent [19]

Matsubara

[11] Patent Number: 4,946,034

[45] Date of Patent: Aug. 7, 1990

[54] PROTECTIVE CASE AND MANUAL FOR FISHING TACKLE

[75] Inventor: Teiji Matsubara, Huntington Beach, Calif.

[73] Assignee: Daiwa Seiko, Inc., Tokyo, Japan

[21] Appl. No.: 343,726

[22] Filed: Apr. 27, 1989

[51] Int. Cl.[5] ..... B65D 85/00

[52] U.S. Cl. ..... 206/315.11; 206/45.34; 206/237; 206/459; 206/470; 206/471

[58] Field of Search ..... 206/315.1, 315.11, 45.34, 206/461, 470, 471, 459, 232; 220/20.5; 229/2.5; 43/26

[56] References Cited

U.S. PATENT DOCUMENTS

| | | | |
|---|---|---|---|
| 2,149,087 | 2/1939 | Fisher | 43/26 |
| 3,256,978 | 6/1966 | Srigley et al. | 206/232 |
| 3,762,592 | 10/1973 | Mayes | 206/315.11 X |
| 3,800,998 | 9/1974 | Gask | 229/2.5 R |
| 4,136,478 | 1/1979 | Wycoshy | 43/26 |
| 4,171,588 | 10/1979 | Hoffman et al. | 43/26 |
| 4,359,161 | 11/1982 | Sinoff | 206/315.11 |
| 4,423,811 | 1/1984 | Knapp | 206/470 X |
| 4,493,416 | 1/1985 | Steinman | 206/315.11 |
| 4,512,474 | 4/1985 | Harding | 206/461 |
| 4,519,500 | 5/1985 | Perchak | 206/459 X |
| 4,669,610 | 6/1987 | Lindsey et al. | 206/461 X |
| 4,676,446 | 6/1987 | Ciocarelli et al. | 206/470 X |

*Primary Examiner*—Bryon P. Gehman

*Attorney, Agent, or Firm*—Kalish & Gilster

[57] ABSTRACT

The present invention relates to a fishing tackle protective case which covers both a reel and a reel-mounted section of a fishing rod with the reel mounted on the fishing rod. The present protective case comprises a box member for containing a reel mounted on a fishing rod and a cylindrical member for covering the reel-mounted section of the rod. The box member and the cylindrical member are made of transparent or translucent synthetic resin material in an integral form. The box and cylindrical members have an depression for receiving the foot of the reel.

4 Claims, 3 Drawing Sheets

PROTECTIVE CASE AND MANUAL FOR FISHING TACKLE

BACKGROUND OF THE INVENTION

This invention relates to a fishing tackle protective case which covers both a reel and a reel-mounted section of a fishing rod with the reel mounted on the rod.

As is widely known, many fishing stores usually employ two methods of selling articles. According to one method, a fishing rod is sold separately from a reel, while the fishing rod is sold with the reel mounted on it according to the other.

The former method permits the fising rod to be put in its protective cover and the reel to be contained in its box. This can reduce chances for possible soiling of those articles while they are on display and at the same time, this can eliminate much trouble with sellers in keeping them clean.

On the other hand, the latter does not require each purchaser to select a fishing rod and a reel separately and most purchasers prefer that sales method to the former.

When the fishing rod displayed with the reel mounted on it is handed to the purchaser, however, it is very hard to wrap them up together because the reel is projecting.

This explains the fact that plain packaging has been adopted to cover the reel only and almost all the articles have been left uncovered during display.

A prior protective case for a fishing reel has been disclosed in Japanese Utility Model Laid-open No. 120075/81, which is used to cover the reel only. That case is different from this invention in its purposes. That prior case covers the main body of the reel and does not cover the reel's foot attached to a fishing rod. Therefore, that case cannot be used to protect both the reel and the reel-mounted section of the fishing rod. That prior case makes little difference in effect from a case for a reel or fishing rod only and also causes the same problems as mentioned above.

Thus, the fishing rod with the reel mounted on it may be frequently touched or held by customers while on display in the store. This results in soiling of them and their commercial value may finally be depreciated. In addition, removal of the reel from the rod is very easy and the reel may be removed or lost accidentally.

Conventionally, the owners manual for any fishing tackle is separated from the tackle itself and put in place in the store. A customer who wants to see the owners manual must go there to see it or ask a salesman to show it from time to time. Additionally, each of those articles is required to have an appropriate sticker indicating the universal product code.

Most purchasers want to store their fishing rods without removing the reels from them until they go fishing. If the fishing rod and reel are not protected satisfactorily during storage, the reel may be soiled or damaged.

SUMMARY OF THE INVENTION

It is, therefore, an object of the present invention to provide a fishing tackle protective case which covers both a reel and a reel-mounted section of a fishing rod.

It is another object of the present invention to provide a fishing tackle protective case which avoids possible exposure of the reel even if a customer holds it in a fishing store.

It is still another object of the present invention to provide a fishing tackle protective case which can contain the owners manual in position so that the purchaser may see the fishing tackle and the manual at a glance without soiling the manual.

It is still another object of the present invention to provide a fishing tackle protective case which can contain a universal product code integrally provided to the owners manual.

It is still another object of the present invention to provide a package for a reel mounted on a fishing rod, which packages the reel together with the reel-mounted section of the rod through a fishing tackle protective case.

DESCRIPTION OF THE PREFERRED EMBODIMENT

Figure 1:
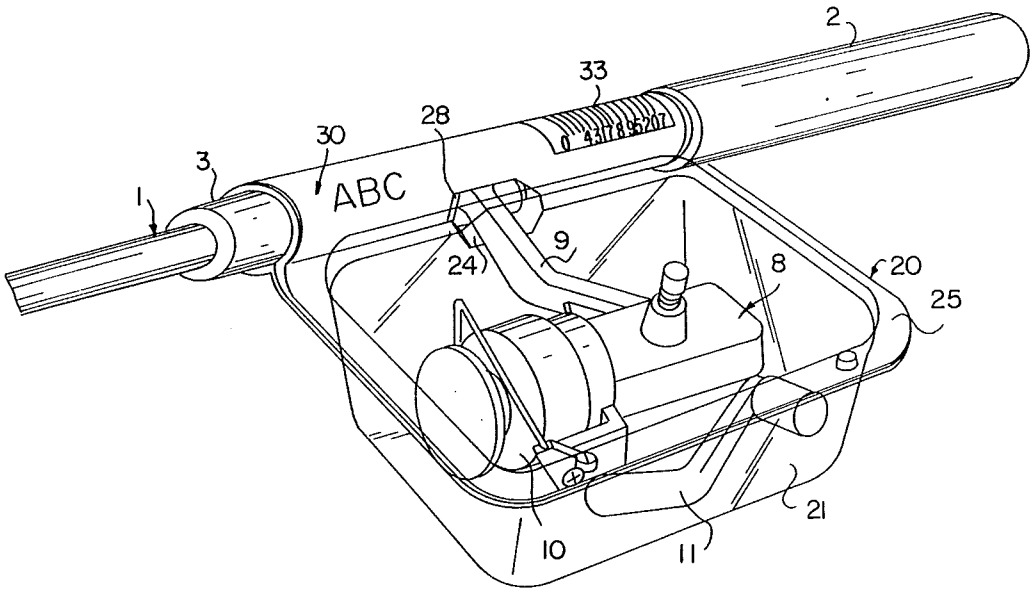
FIG. 1 is a perspective view of a package, in which a fishing equipment protective case according to the present invention is applied to a fishing rod with a spinning reel mounted on it.
Figure 2:
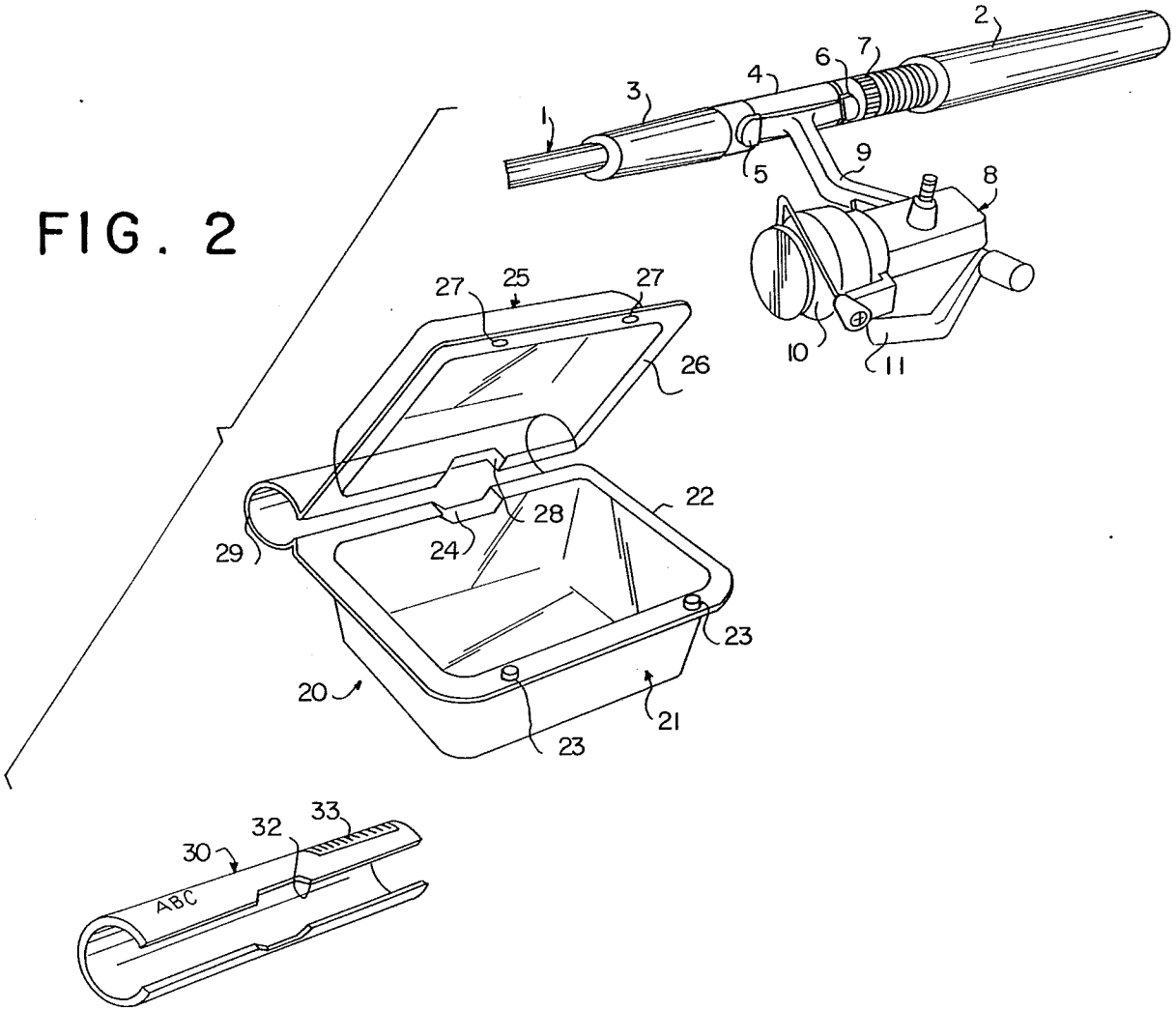
FIG. 2 is a perspective view showing a fishing tackle protective case shown in FIG. 1 and a fishing rod with a spinning reel mounted on it, separately.

FIGS. 1 and 2 show an embodiment of the present invention, in which the reference numeral 1 shows a fishing rod.

The fishing rod 1 has two grips 2 and 3 attached to its base. The grips 2 and 3 form an area where a fisherman grips the rod to operate it during fishing and are usually made of foaming material. Between the grips 2 and 3, a reel seat 4 is provided. The reel seat 4 has rings 5 and 6 to hold a foot 9 of a spinning reel 8, and the ring 6 is adapted to move as a nut 7 rotates.

The spinning reel 8 has certain fishing line wound round the spool 10. In FIG. 1, a handle 11 is removed to make the reel compact for packaging.

A protective case 20 is made of transparent or translucent synthetic resin, for example, vinyl chloride resin or polypropylene resin. The protective case 20 comprises a case body 21 which has room for containing the spinning reel 8 and the handle 11, a lid 25 which covers the opening of the case body 21, and a cylindrical hinge 29 which couples the case body 21 and the lid 25, and those three members 21, 25 and 29 are integrally formed as the case 20.

Both the case body 21 and the lid 25 have plate-like flanges 22 and 26, respectively. The flange 22 lies upon the flange 26 completely when they are put together to shut the case 20. The flange 22 has projections 23 and the flange 26 has depressions 27 to receive the projections 23 for engagement.

The case body 21 and the lid 25 have depressions 24 and 28, respectively, which are provided to receive the foot 9 of the spinning reel 8 and to contain the base of the foot 9 within the hinge 29.

The owners manual 30 is formed into a cylindrical shape like the hinge 29 so that the manual 30 can be located on the inner wall of the hinge 29. The owners manual 30 also has depressions 31 and 32 at the locations adjacent to the case body 21 and the lid 25. Those depressions 31 and 32 are provided to receive the foot 9 of the spinning reel 8, as with the depressions 24 and 28.

In addition, on the owners manual 30, a universal product code 33 is printed.

As shown in FIG. 2, to package the fishing rod 1 and the spinning reel 8 mounted on it with the fishing tackle protective case 20 according to the present invention, the owners manual 30 is first attached to the reel seat 4 of the rod 1. After attachment, it must be verified that the depressions 31 and 32 of the owners manual 30 are located precisely at an area for receiving the foot 9 of the spinning reel 8. The reel seat 4 is then thrusted into the hinge 29 of the protective case 20 and at the same time, the spinning reel 8 is put into the case body 21. It must be verified that the foot 9 of the reel 8 is located within the depression 24 of the case body 21. Then, the handle 11 is put in the case body 21. Lastly, the lid 25 is moved toward the case body 21 and the projections 23 of the case body 21 are fit in the depressions 27 of the lid 25 to engage the case body 21 and the lid 25.

The series of operations allows integral packaging of the spinning reel 8 mounted on the fishing rod 1 together with the reel seat 4 and the grips 2 and 3, as shown in FIG. 1.

With thus obtained package, as may be see from FIG. 1, the spinning reel 8 and the handle 11 can be seen through the case body 21 and the lid 25 comprising the transparent or translucent protective case 20 for fishing equipment. Also the owners manual 30 and the universal product code 33 can be seen through the hinge 29 of the protective case 20 in a similar manner. In addition, engagement between the case body 21 and the lid 25 makes the protective case 20 integral and permits the foot 9 of the spinning reel 8 to be surrounded by the depressions 24 and 28 of the case body 21 and the lid 25, respectively. If a customer swings the fishing rod 1 holding the grip 2, there may be no chance for removal of the protective case 20. The present protective case 20, of course, can prevent any customer from directly touching the spinning reel 8 and the reel seat 4 and the grip 3 covered with the hinge 29 of the case 20, resulting in no soiling of them. Moreover, as shown in FIG. 1, the hinge 29 of the protective case 20 acts as a display section for the owners manual 30 and the universal product code 33 and at the same time, it also prevents any customer from touching the manual 30 and the product code 33. This can avoid soiling of them while the customer checks the articles. The case body 21 and the lid 25 can be removed from the fishing tackle and can be used as a protective cover for the fishing tackle purchased.

Figure 3:
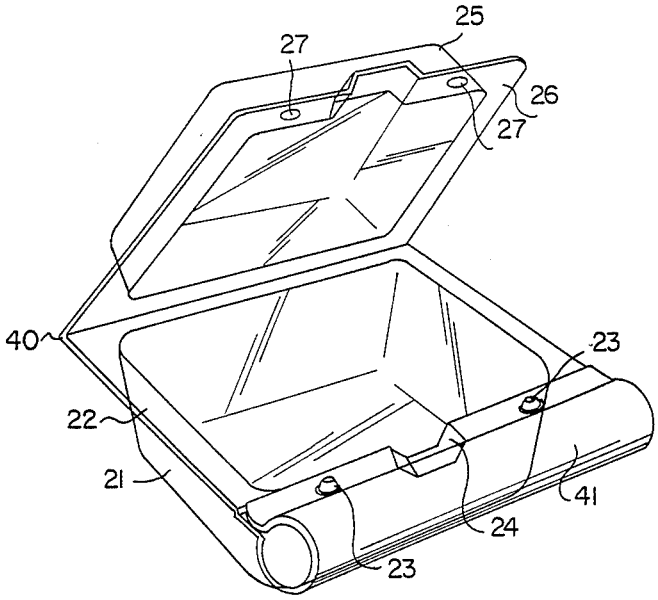
FIG. 3 is a perspective view of another embodiment of a fishing tackle protective case according to the present invention.

In the above embodiment, the hinge 29 between the case body 21 and the lid 25 contains the owners manual 30. However, as shown in FIG. 3, the hinge 40 may be separated from the display section 41. The display section 41 is formed by extending the flange 22 of the case body 21 and turning up the extension in a cylindrical form.

According to the second embodiment shown in FIG. 3, the owners manual 30 is installed within the cylindrical display section 41 together with the fishing rod 1 before the case body 25 is closed.

The second embodiment can take the same action and effect as the first embodiment described above.

Those embodiments are described with the spinning reel 8 mounted in position. The present invention, however, is not limited to use of the spinning reel and is applicable to any type of reels which can be mounted on a fishing rod for sale. The reel seat used with the above embodiments has one movable end but may be any type of seats on which a reel can be mounted. In addition, the universal product code printed on the owners manual is used with the above embodiments, but it may be attached to the hinge or display section during manufacture. In the above embodiments, engagement of the projections and depressions provided in the case body and the lid permits the case to open and close. However, the case may be prohibited to open, for example, by applying heat to the mating flanges for sealing. The universal product code, of course, may not be provided integrally with the owners manual, if necessary.

I claim:

1. A fishing tackle protective case comprising a box member for containing a fishing reel mounted by a foot thereof on a fishing rod and a cylindrical member for covering a fishing reel-mounted section of said fishing rod, both the box member and cylindrical member being integrally formed of transparent or translucent synthetic resin material, said box member comprising a case body for containing the fishing reel while mounted on the fishing rod and a lid for covering the opening of the case body, the case body and lid both being integrally connected with the cylndrical member, the case body and lid both flanges forming outwardly projecting flanges having projections and depressions formed respectively therein, the case body and the lid being made so as to be integrally closed by engaging the respective projections and depressions, the case body and the lid when closed forming only a reel foot opening extending from the case body to the cylindrical member for receiving the reel foot, said cylindrical member accommodating an owner's manual formed in a shape to coincide with the foot opening for engagement of the reel foot, the owner's manual being notched along one edge to provide a depression engaging the reel foot to retain the manual within the cylindrical portion.

2. A fishing tackle protective case according to claim 1, wherein each of the case body and the lid defines a depression, such depressions being aligned for together forming the foot opening when the case body and the lid are closed.

3. A fishing tackle protective case comprising a box member for containing a fishing reel mounted by a foot thereof on a fishing rod and a cylindrical member for covering a fishing reel-mounted section of said fishing rod both being integrally formed of transparent or translucent synthetic resin material, said box member consisting of a case body for containing the fishing reel mounted on the fishing rod and a lid for covering the opening of the case body, the case body and lid forming said box member being connected with a hinge, the case body and lid having flanges formed to project outwardly, these flanges having projections and depressions formed respectively therein, and the case body and lid being so made as to be integrally closed by engaging the projections and depressions, the case body when closed with the lid forming only a reel foot opening extending from the case body to the cylindrical member for receiving the foot of the fishing reel, said cylindrical member accommodating an owner's manual formed in a shape to coincide with the foot opening for engagement of the foot of the fishing reel, the owner's manual being notched along one edge to provide a depression engaging the reel foot to retain the manual within the cylindrical portion.

4. A fishing tackle protective case according to claim 3 wherein each of the case body and the lid defines a depression, such depressions being aligned for together forming the foot opening when the case body and the lid are closed.

* * * * *

UNITED STATES PATENT AND TRADEMARK OFFICE

CERTIFICATE OF CORRECTION

PATENT NO. : 4,946,034

DATED : Aug. 7, 1990

INVENTOR(S) : T. Matsubara

It is certified that error appears in the above-identified patent and that said Letters Patent is hereby corrected as shown below:

Col. 4, line 22, Insert a comma after "lid";

line 43, Insert a comma after "rod".

Signed and Sealed this

Twenty-fourth Day of September, 1991

*Attest:*

HARRY F. MANBECK, JR.

*Attesting Officer*

*Commissioner of Patents and Trademarks*